US010376729B2

(12) United States Patent
Fuller

(10) Patent No.: US 10,376,729 B2
(45) Date of Patent: Aug. 13, 2019

(54) EXERCISE DEVICE FOR PADDLE SPORTS

(71) Applicant: Peter Fuller, New York, NY (US)

(72) Inventor: Peter Fuller, New York, NY (US)

( * ) Notice: Subject to any disclaimer, the term of this patent is extended or adjusted under 35 U.S.C. 154(b) by 0 days.

(21) Appl. No.: 13/953,529

(22) Filed: Jul. 29, 2013

(65) Prior Publication Data

US 2014/0162848 A1 Jun. 12, 2014

Related U.S. Application Data

(60) Provisional application No. 61/676,697, filed on Jul. 27, 2012.

(51) Int. Cl.

| | |
|---|---|
| ***A63B 21/00*** | (2006.01) |
| ***A63B 21/02*** | (2006.01) |
| ***A63B 69/06*** | (2006.01) |
| ***A63B 21/015*** | (2006.01) |
| ***A63B 21/05*** | (2006.01) |
| ***A63B 22/20*** | (2006.01) |
| ***A63B 23/035*** | (2006.01) |
| ***A63B 23/12*** | (2006.01) |
| ***A63B 21/04*** | (2006.01) |

(52) U.S. Cl.

CPC .... *A63B 21/0004* (2013.01); *A63B 21/00069* (2013.01); *A63B 21/015* (2013.01); *A63B 21/023* (2013.01); *A63B 21/0428* (2013.01); *A63B 21/05* (2013.01); *A63B 22/20* (2013.01); *A63B 23/03516* (2013.01); *A63B 23/1209* (2013.01); *A63B 69/06* (2013.01); *A63B 21/025* (2013.01); *A63B 21/4035* (2015.10); *A63B 21/4043* (2015.10); *A63B 21/4045* (2015.10)

(58) Field of Classification Search

CPC . A63B 25/08; A63B 69/0028; A63B 21/0004; A63B 22/20; A63B 69/06; A63B 21/00069; A63B 21/0428; A63B 23/1209; A63B 23/03516; A63B 21/015; A63B 21/05; A63B 21/023; A63B 21/4035; A63B 21/4043; A63B 21/4045; A63B 21/025; A63B 22/00; A63B 22/0076; A45B 3/00; A45B 9/00; A45B 1/00

USPC ..... 482/74, 51, 71, 115, 117; 135/65–77, 85

See application file for complete search history.

(56) References Cited

U.S. PATENT DOCUMENTS 2,445,942 A * 7/1948 Dusinberre ..... A61H 3/068 135/85
2,590,052 A * 3/1952 Patterson ..... A45B 9/04 135/85
2,802,479 A * 8/1957 Hickman ..... A45B 9/00 135/65

(Continued)

*Primary Examiner* — Andrew S Lo
(74) *Attorney, Agent, or Firm* — Mintz Levin

(57) ABSTRACT

An exercise device is provided that replicates on dry land the movement and resistance of a paddling motion. The exercise device includes a hollow upper shaft, a handle connected to an upper end of the upper shaft, and a lower shaft coupled at least partially within the upper shaft by a spring, to allow retraction into and extension from the upper shaft. The exercise device further includes a blade replacement assembly connected with a bottom end of the lower shaft, the blade replacement assembly comprising one or more wheels connected with a bottom end of the lower shaft and a resistance mechanism to provide resistance against a rolling direction of the one or more wheels.

2 Claims, 2 Drawing Sheets

(56) References Cited

U.S. PATENT DOCUMENTS

| | | | | | |
|---|---|---|---|---|---|
| 3,223,099 | A * | 12/1965 | Hagood, Sr. | A45B 1/02 | 135/66 |
| 4,826,151 | A * | 5/1989 | Nuredin | A63B 21/0004 | 297/423.38 |
| 4,958,651 | A * | 9/1990 | Najm | A61H 3/068 | 135/65 |
| 5,037,088 | A * | 8/1991 | Bernstein | A63B 21/0004 | 482/112 |
| 5,478,283 | A * | 12/1995 | Hoblit | A63B 71/00 | 273/129 L |
| 5,938,240 | A * | 8/1999 | Gairdner | A63C 17/0013 | 135/85 |
| 7,866,430 | B2 * | 1/2011 | Kakinuma | B62K 11/007 | 180/218 |
| 2009/0280965 | A1 * | 11/2009 | Shapiro | A63B 69/06 | 482/72 |
| 2010/0204020 | A1 * | 8/2010 | Thomas | A63B 22/0015 | 482/72 |

* cited by examiner

EXERCISE DEVICE FOR PADDLE SPORTS

CROSS REFERENCE TO RELATED APPLICATIONS

This application claims priority to U.S. Provisional Application No. 61/676,697, which was filed on Jul. 27, 2012, entitled, "Exercise Device for Paddle Sports." The disclosure of the priority application and any other documents referenced herein are incorporated by reference in their entirety for all purposes to the extent possible under applicable laws unless otherwise stated.

TECHNICAL FIELD

This disclosure relates generally to exercise devices, and more particularly to an exercise device for paddle sports.

BACKGROUND

Paddle sports have a person or group of people who float on a floatable implement such as a board or a boat, and who derive mobility from the use of a paddle guided through water near the floatable implement. Paddle sports include stand-up paddle boarding (SUP), rowing, kayaking, canoeing (outrigger or regular), and the like. In addition to being fun, any of the paddle sports such as SUP can be an extremely demanding physical activity, and provides the user with an excellent opportunity to improve their flexibility, balance (which in itself requires constant muscle activity), strength and cardiovascular endurance. For example, because of its nature, including both the body position used while paddling and the paddling action itself, SUP exercises a wide range of muscle and muscle groups, including the core muscles (the generally larger and deeper muscles around the body's trunk and the hips and butt) that are extremely important for proper function and performance as they balance and stabilize the pelvis and spine and provide for optimal power and balance and overall wellbeing. And, since paddling requires near-constant motion and the simultaneous use of many muscle and muscle groups, paddling is also an excellent aerobic exercise.

Trainers, SUP enthusiasts and experts have devised numerous exercises, training programs and circuit training programs in an attempt to broadly and specifically work the various muscles and muscle groups involved in paddle boarding, including hard-to-work core muscles and muscles that are key for maintaining balance. Other exercise regimes, cardio and aerobic training programs are also employed. Some trainers recommend practicing yoga (called "yoco" for yoga/core) and Pilates on a SUP, the idea being to enhance flexibility, balance and core muscle building.

Regretfully, any and all of the various routines used for SUP training fall woefully short: While these exercise programs may ultimately exercise the various muscles and muscle groups used in SUP, as well as provide aerobic exercise and balance training, typically each muscle group is exercised sequentially, not in parallel, and the aerobic and balance training components are done independently from the muscle training. Simply put, SUP provides a simultaneous, full-body, comprehensive workout where virtually all muscles and muscle groups are worked simultaneously, along with aerobic exercise, flexibility and balance training.

Persons who engage in such sports usually must train on the actual implement for optimal conditioning, as it is very difficult, if not impossible, to faithfully replicate the muscular resistance and development experienced from moving an actual paddle through water in accordance with proper techniques. Further, there is presently no device that allows a person to replicate the proper technique and movement of a paddle being guided through water.

SUMMARY

In general, this document discloses an exercise device that is configured to replicate the proper technique and movement of a paddle being guided through water. The exercise device can be used by a person on dry land, i.e, out of the water. The exercise device addresses the shortcomings of traditional training programs by offering the user an opportunity to enjoy a comprehensive, quality, paddleboard type work-out by providing the user with a device that mimics the paddling motion, essentially assuring that, and forcing, all the various muscles and muscle groups work together, thus resulting in a comprehensive, high-quality work-out whilst eliminating the need to have a paddle board, a location to paddle and suitable weather.

The exercise device includes a hollow upper shaft, a handle connected to an upper end of the upper shaft, and a lower shaft coupled at least partially within the upper shaft by a spring, to allow retraction into and extension from the upper shaft. The exercise device further includes a blade replacement assembly connected with a bottom end of the lower shaft, the blade replacement assembly comprising one or more wheels connected with a bottom end of the lower shaft and a resistance mechanism to provide resistance against a rolling direction of the one or more wheels.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes an exercise device that is configured to replicate the proper technique and movement of a paddle being guided through water, to allow a person to build strength and muscle learning from using the exercise device.

Figure 1:
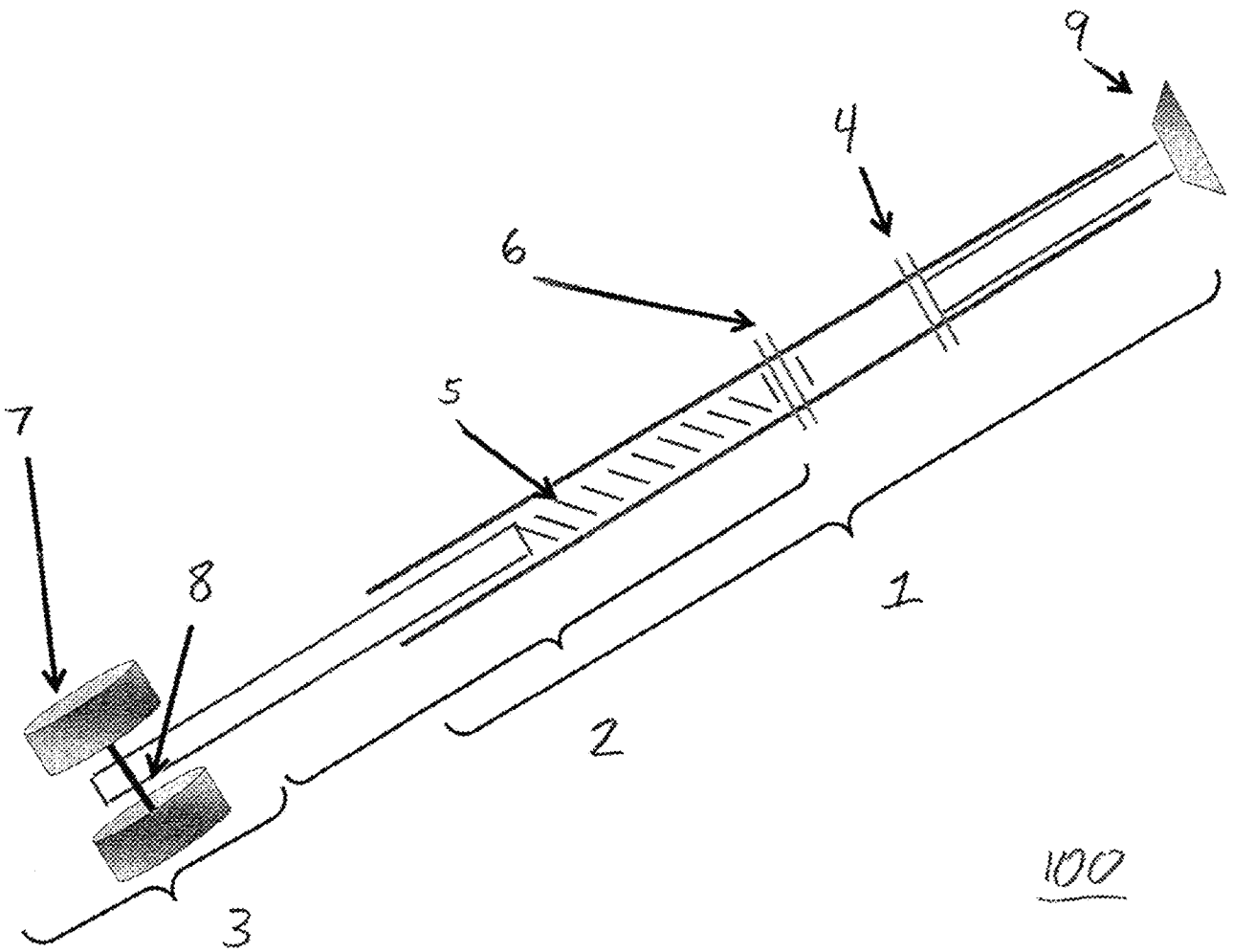
FIG. 1 illustrates an exercise device.

FIG. 1 illustrates an exercise device 100 for paddle sports. The exercise device 100 includes an upper shaft assembly 1 that is hollow and which partially houses a lower shaft assembly 2. The upper shaft assembly 1 and/or the lower shaft assembly 2 are preferably cylindrical with a circular cross-sectional shape, but can have other cross-sectional shapes as well. The upper shaft assembly 1 includes a spring loaded button pin mechanism 6 for variable placement within a number of spaced-apart holes on the upper shaft assembly 1, and which is adapted for connection with a top end of the lower shaft assembly 2 by spring 5, allowing the lower shaft assembly 2 to flexibly retract into and extend from upper shaft assembly However, any other type of connection mechanism can be used in place of the spring loaded button pin mechanism 6 for connection to the spring 5, and any type of compressible and/or reformable member can be used in place of spring 5.

The upper shaft assembly 1 can include a handle for being grasped by a user for receiving downward and/or backward force on the exercise device 100. The handle itself can be coupled to a top end of a handle shaft, which in turn can be connected at a bottom end with the upper shaft assembly by a second spring-loaded button pin mechanism 4. Other connecting or coupling mechanisms can be used, such as threading, bolts, screws, or any other type of connector or coupler. In some implementations, the handle shaft may also be connected to the second spring-loaded button pin mechanism 4 by a spring or other compressible member or biasing member.

A blade replacement assembly 3 is connected to a bottom end of the lower shaft assembly 2, to be positioned at the bottom of the exercise device 100 opposite the handle. The blade replacement assembly 3 includes one or more wheels 7 coupled with the lower shaft assembly 2 via a resistance mechanism 8. The resistance mechanism 8 can include a friction-based resistance mechanism, or a wind-up spring, or the sort, and provides counter-resistance to the one or more wheels 7 when the one or more wheels roll.

Accordingly, the exercise device 100 operates similar to a paddle, in which a user grasps the handle or near the top end of the upper shaft assembly 1 with one hand, and grasps a position on the upper shaft assembly 1 lower than the second spring loaded button pin mechanism 4 with the other hand. The handle and handle shaft can be fixed or compressible within the upper shaft assembly 1. A force exerted by the user down on the handle with the one hand, and a force pulling the upper shaft assembly 1 with the other hand, compresses the lower shaft assembly 2 into the upper shaft assembly 1 by compression of interconnecting spring 5. At the same time, the force pulling the upper shaft assembly 1, as assisted by the force down on the handle, activates the one or more wheels 7 to roll in the direction of the pulling force, and the resistance mechanism 8 to be activated to simulate the resistance qualities of water. In this manner, the exercise device 100 simulates a paddle with a blade being stroked through water.

The exercise device 100, and in particular the upper shaft assembly 1, is preferably shaped and/or sized to resemble a shape and length of a paddle for a particular paddle sport. Therefore, the exercise device 100 can have a generally elongated cylindrical shape. The one or more wheels 7 can have any of a number of diameters, widths or other shapes. The one or more wheels 7 can also have any of a number of durometers or softness, contributing to the resistance mechanism 8 and smoothness of the exercise device 100. The one or more wheels 7 can be coupled by an axle to the resistance mechanism and/or bottom end of the lower shaft assembly 2, and the axle may be able to pivot to account for an angle of contact made by the exercise device 100 to a solid surface.

The upper shaft assembly 1, lower shaft assembly 2, handle 9, and other parts may be made of a rigid, non-corroding material such as aluminum, steel, or other metal, or plastic, carbon fiber, or other synthetic material. Some or all of the parts of the exercise device may be made of organic materials such as wood, bamboo, or the like.

In operation, and according to some implementations, a paddling action using the exercise device 100 can be broken down into three semi-distinct phases: In the first phase, the blade of the paddle enters the water slightly in front and to the side of the paddler. In the second phase, the paddler begins to pull the paddle along the side of the paddle board through a coordinated motion involving the knees and hips flexing (causing the body to dip), the torso rotating and by pulling back with the bottom hand and down by the top hand. In the proper stroke, the back and shoulder muscles, as well as a cadre of muscles in the paddle's arms, work in concert with flexing of the spine and body twist, which emphasizes the abdominal muscles and core muscle groups, to generate optimal power. During the later part of the second phase, when the blade has passed about one-half the way towards the paddler's feet, the subtle changes in the activation of the muscles of the lower leg provide balance and additional power is generated as the large muscles in the legs become activated.

Finally, in the third phase, as the blade passes the centerline of the body, the paddler enters the push phase wherein force is created by the combined action of the leg drive, rotation of the hips and torso and the extension of the triceps. At the end of the stroke, the paddle is lifted from the water in a clean, sweeping motion, at which point the positioning of the hands are reversed and the paddler prepares to duplicate the stroke action on the opposite side of the board.

Figure 2:
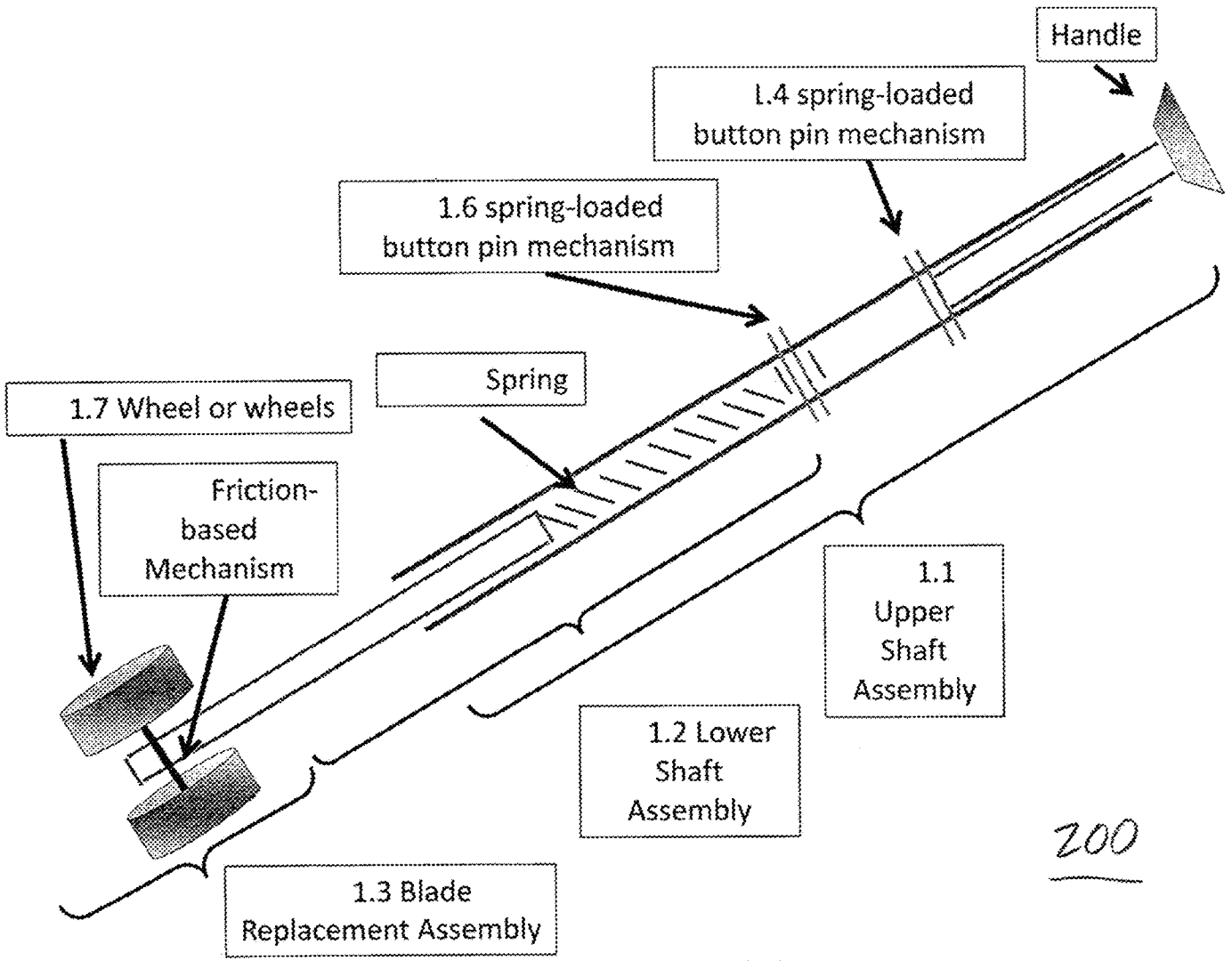
FIG. 2 illustrates an exercise device and its operation.

In some implementations, and according to an alternative description, an exercise device 200 as illustrated in FIG. 2 includes three semi-distinct functional components, the upper shaft assembly (1.1) including the handle, the lower shaft assembly (1.2) and the blade replacement assembly (1.3).

The upper shaft assembly, which in some implementations makes up about one-half to two-thirds the total length of the exercise device and looks and functions exactly like a standard paddle board paddle, includes a handle and tubular shaft and, if desirable, a mechanism to shorten or lengthen the shaft length to accommodate users of different heights (as commonly found on commercially available paddles, as shown, a spring loaded button pin mechanism (1.4)).

In the implementation shown in FIG. 2, the lower shaft assembly also is formed of a tubular shaft, with the outside diameter of the lower shaft being slightly smaller than the inside diameter of the upper shaft, such that the upper end of the lower shaft fits comfortably into and moves freely inside the lower end of the upper shaft. Connected to the upper end of the lower shaft is a spring (1.5) that is the same or slightly smaller outside diameter as the lower shaft. In one implementation, connected to the opposite end of the spring is a spring-loaded button pin mechanism (1.6) that when compressed, allows the lower shaft to move freely inside the upper shaft. Positioned along the upper shaft are a series of paired holes (one on each side of the upper shaft) such that when the compressed spring-loaded button pin mechanism encounters a set of the holes, the spring decompresses and the buttons extend out into the holes, thus locking the two shafts together at a single point. When locked, the upper end of the lower shaft can move up into the lower end of the upper shaft provided that the spring is appropriately compressed, but the lower shaft cannot fall out of the lower end of the upper shaft.

As the paddler performs the first phase of the paddle stroke, essentially pushing down on the device, the spring compresses, and allows the upper part of the lower shaft to travel the requisite distance up and inside the lower end of the upper shaft, thus mimicking the action of the blade entering the water and the body movements inherent thereto.

The third component includes blade replacement assembly (1.3). In one implementation, this component comprises one or more wheels (1.7) connected to, and positioned with the axle of the wheel(s) perpendicular to the lower end of the shaft or slightly offset from perpendicular to the lower end of the shaft at an angle similar to the angle resulting during the paddling motion, thus assuring the wheel(s) are flat against the rolling surface even when the device is in use. And, the wheel(s) can be oriented such that it/they roll parallel to the tract of the paddle stroke. In one implementation, the wheel has a friction-based mechanism (1.8) to adjust the amount of rolling resistance and hence the effort required for the wheel to roll: The more friction, the more effort required, and vice-versa. The rolling resistance mimics that effort to perform the late first phase, the second phase, and early third phase of the paddle stroke described above.

The combined action of the lower shaft compressing into the upper shaft and the rolling resistance of the wheel or wheels on the blade replacement component leads to a set of motions that accurately mimics a proper paddle stroke and thus provide all the benefits inherent thereof.

In some implementations, the upper end of the lower shaft is connected to the lower end of the upper shaft with a spring-loaded hinge, such that at resting, the shafts are aligned and straight. During the first phase of the paddle stroke, and as the user pushes down (as if to put the blade in the water), the hinge flexes, thus allowing the handle to be pushed downward. The amount of tension required to flex the hinge can be adjustable.

Particular implementations have been described. Other implementations are within the scope of the following claims.

The invention claimed is:

1. An exercise device comprising:

a hollow upper shaft having two or more pin holes arranged along a length of the hollow upper shaft, the hollow upper shaft further defining a region below the two or more pin holes, the region for being grasped by a first hand of a user for lateral pulling of the hollow upper shaft to move the exercise device;

a handle connected to an upper end of the upper shaft by a first spring-loaded pin mechanism in one of the two or more pin holes, the handle being sized and configured for being grasped by a second hand of the user for downward pushing on the handle to assist in moving the exercise device, the handle being compressible within the hollow upper shaft;

a lower shaft coupled at least partially within the upper shaft by a second spring-loaded pin mechanism engaged with another pin hold of the two or more pin holes, the second spring-loaded pin mechanism being connected with a spring in the lower shaft to allow coaxial retraction by the lower shaft into the upper shaft based on the downward pushing on the exercise device by the second hand of the user, and coaxial extension by the lower shaft from the upper shaft based on a biasing of the spring toward the coaxial extension; and a blade replacement assembly connected with a bottom end of the lower shaft, the blade replacement assembly comprising one or more wheels connected with a bottom end of the lower shaft, the blade replacement assembly further comprising a resistance mechanism to provide resistance against a rolling direction of the one or more wheels, the resistance mechanism including a wind-up spring for providing counter resistance against the movement of the one or more wheels.

2. An exercise device comprising:

a hollow upper shaft having two or more first pin holes arranged in an upper region of the hollow upper shaft, the hollow upper shaft further defining a region below the two or more first pin holes, the region for being grasped by a first hand of a user for lateral pulling of the hollow upper shaft to move the exercise device;

a handle connected to the upper region of the upper shaft by a first spring-loaded button pin via one of the two or more first pin holes, the handle being sized and configured for being grasped by a second hand of the user for downward pushing on the handle to assist in moving the exercise device, the handle being compressible within the hollow upper shaft;

a lower shaft coupled at least partially within the upper shaft by a second spring-loaded button pin;

a spring connected between an upper end of the lower shaft and the second spring-loaded button pin, the spring allowing the lower shaft to coaxially retract into and extend from the upper shaft under respective application and removal of the downward pushing on the exercise device by the second hand of the user; and a blade replacement assembly connected with a bottom end of the lower shaft, the blade replacement assembly comprising one or more wheels connected with a bottom end of the lower shaft, the blade replacement assembly further comprising a resistance mechanism to provide resistance against a rolling direction of the one or more wheels, the resistance mechanism comprising a wind-up spring.

* * * * *